United States Patent [19]

Steiner et al.

[11] Patent Number: 4,595,859

[45] Date of Patent: Jun. 17, 1986

[54] HALOGEN INCANDESCENT LAMP AND SOCKET COMBINATION, PARTICULARLY FOR DIRECT ASSEMBLY INTO A FIXTURE WITH BAYONET LOCK

[75] Inventors: Hermann Steiner, Herbrechtingen; Walter Schönherr, Giengen-Hürben; Peter Helbig, Sontheim, all of Fed. Rep. of Germany

[73] Assignee: Patent-Treuhand-Gesellschaft, Munich, Fed. Rep. of Germany

[21] Appl. No.: 592,938

[22] Filed: Mar. 23, 1984

[30] Foreign Application Priority Data

Apr. 15, 1983 [DE] Fed. Rep. of Germany ... 8311269[U]

[51] Int. Cl.[4] ..... H01K 1/42

[52] U.S. Cl. ..... 313/579; 313/318; 339/144 T; 339/145 T

[58] Field of Search ..... 313/318, 579; 339/144 T, 144 R, 145 R, 145 T, 17 D, 91 L, 90 F

[56] References Cited

U.S. PATENT DOCUMENTS

| | | | |
|---|---|---|---|
| 1,760,693 | 5/1930 | Gustin | 339/145 R X |
| 3,859,554 | 1/1975 | Preziosi et al. | 313/318 X |
| 4,152,622 | 5/1979 | Fitzgerald | 313/318 |
| 4,489,252 | 12/1984 | Eckhardt | 313/318 |

FOREIGN PATENT DOCUMENTS

| | | | |
|---|---|---|---|
| 2435836 | 5/1980 | France | 313/318 |
| 1384739 | 2/1975 | United Kingdom | 313/318 |
| 2025162 | 1/1980 | United Kingdom | 339/17 D |

*Primary Examiner*—Palmer C. DeMeo

*Attorney, Agent, or Firm*—Frishauf, Holtz, Goodman & Woodward

[57] ABSTRACT

To permit insertion of a lamp-socket combination into a fixture which includes a plate-like portion (P), for example a printed circuit board, a plastic socket (2) is provided which is formed with a recess (6), preferably a through-bore, into which two separating walls (8) extend, which are resiliently outwardly deflectable and have inwardly extending locating ridges (9) which can, after deflection radially outwardly upon insertion of the lamp (1), snap back against the base (4) of the lamp to engage over locating projections (5) formed on the base of the lamp. Terminal strips (7) are inserted in the base at the opposite sides of the separating walls (8), which defines chords of the cylindrical opening (6), the opening providing access for weld-connection of the electrical terminal leads (3) from the lamp to the terminal strips (7).

12 Claims, 3 Drawing Figures

HALOGEN INCANDESCENT LAMP AND SOCKET COMBINATION, PARTICULARLY FOR DIRECT ASSEMBLY INTO A FIXTURE WITH BAYONET LOCK

The present invention relates to an electric lamp and socket combination particularly adapted for insertion into an illumination panel, for combination with a printed circuit board or the like, in which the socket has a bayonet-type connection with a plate-like element of the fixture, or directly with a printed circuit board. The lamp is a halogen incandescent lamp of low power, especially adapted for illumination of a display panel or the like.

BACKGROUND

It has previously been proposed to make halogen incandescent lamps by fitting special metal elements into plastic sockets which, then, can be assembled in various fixtures, in lamp reflectors, and the like. The manufacture of the separate metal holders, plastic holders and the like are costly and cause assembly and manufacturing difficulties. This is particularly so for halogen incandescent lamps of e.g. 6 or 12 V and low power, e.g. a few watts, such as 5 watts or less, although the power consumption itself is not a limiting factor.

THE INVENTION

It is an object to provide a halogen incandescent lamp-socket combination which permits direct assembly in a plate-like holder which may form part of a fixture, or a printed circuit board, which is inexpensive, easy to assemble with the halogen incandescent lamp itself, and permits reliable connection with a fixture or plate-like holder, wherein the lamp is retained in predetermined position with respect to the socket so that its projecting extent from the plate-like fixture—when assembled—is accurately predetermined.

Briefly, the socket is made of a cylindrical element, preferably formed with a through-bore, for easy accessibility, in which the cylindrical element is formed with a pair of inwardly extending, laterally resiliently deflectable separating walls. The separating walls are located at the inside of a recess for resilient engagement with opposite flat sides of a plate-like portion of the base of the lamp, to clamp thereagainst, and, further, are formed with projections, catches or, generally, engagement edges located and shaped to engage holding projections formed on the base of the lamp. The lamp, thus, will be seated reliably within the socket, held in position by snap-in engagement of the resiliently deflectable separating walls, which can press outwardly upon insertion of the lamp but then snap back to engage the lamp. The outer circumference of the socket can be shaped in any suitable manner, for example for direct engagement with a plate-like holder, printed circuit board, and the like. The terminal contact can be easily assembled directly in the holder, for example in the form of metal strips or elements snapped into the holder and held in position by a projecting prong. The terminals can readily be formed as a single piece, gripping around the plate-like holder, if desired.

DRAWINGS

DETAILED DESCRIPTION

Figure 1:
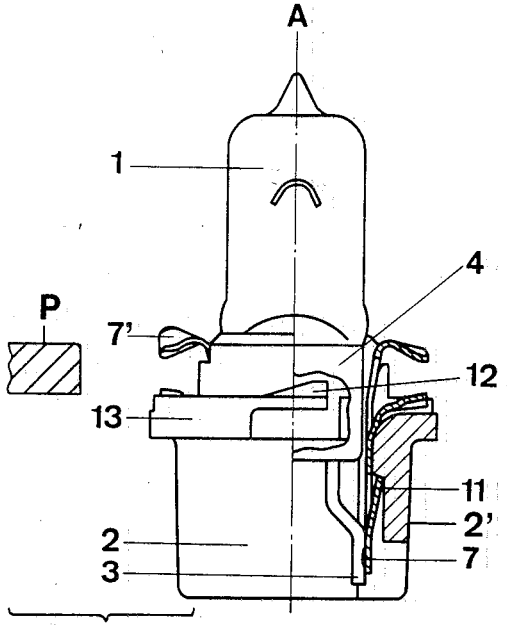
FIG. 1 is a side elevational view, partly in section, of the lamp assembled in the socket.
Figure 3:
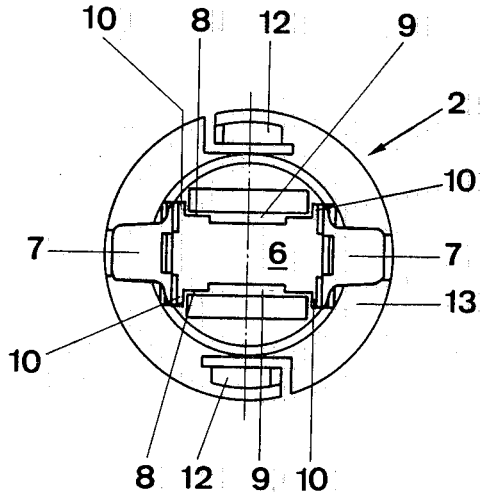
FIG. 3 is a top view, looking down in the direction of the lamp, of the socket element itself, with the lamp removed.

The lamp-socket combination has a halogen incandescent lamp 1 of low power, and a socket element 2. The lamp 1, as well known, has two current conductor leads 3, led outwardly through a glass press base from the end portion of the base. The glass press 4—see FIG. 2—is plate-like and has two flat sides. Engagement projections 5 are formed on the press.

The socket 2, preferably, is made of high temperature-resistant plastic, for example polyamide with 25% glass fiber content. The socket is formed with a recess 6, FIG. 2, to receive socket terminal elements 7 as well as the glass press 4 of the lamp 1.

Figure 2:
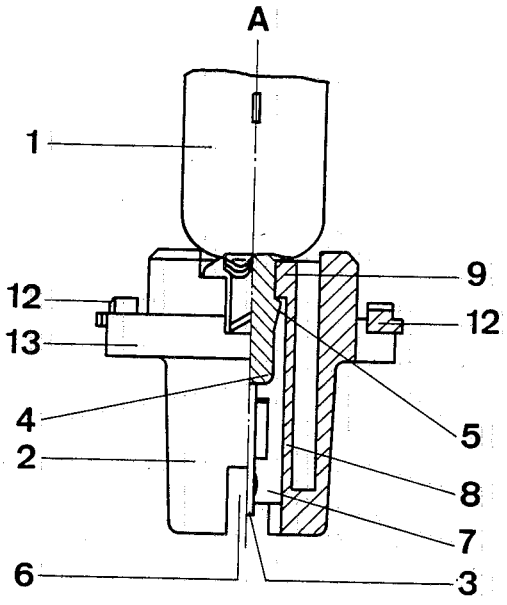
FIG. 2 is a fragmentary side elevational view similar to FIG. 1, but rotated by 90° about a vertical axis A.

In accordance with a feature of the invention, the socket 6 is formed with inwardly extending, intermediate separating walls 8 which are secured to the socket in this example at three sides, preferably by being integral therewith, but free from the remainder of the socket at the top side—see FIG. 2. The separating walls 8, thus, can resiliently engage the wide or flat side of the glass press 4. The lamp 1 is securely retained within the socket by inwardly extending projections 9 which, in assembled condition with the lamp, will engage over the projections 5 on the press 4 of the lamp. The projections 9 form engagement surfaces which extend horizontally—with respect to FIG. 1—in a plane extending perpendicularly to the plane of the sheet of the drawing, and perpendicularly to the longitudinal axis A of the lamp. Upon insertion of the lamp, the walls 8 can resiliently deflect outwardly, and the projections 9 on the walls 8 will then snap over the projections 5 on the base of the lamp, securely holding the lamp in position. Engagement surfaces formed on the inner vertical portion of the projections 9, as well as on the horizontal portion which engage over the projections 5, position the lamp in the socket.

Grooves 10 are formed at both sides of the separating walls 8, extending parallel to the longitudinal axis A, and located at the narrow side of the central opening or recess 6. Socket terminal elements 7, made of sheet metal, are fitted into the grooves 10. The socket terminal elements 7 have an outwardly projecting catch or tongue 11—see FIG. 1—which secures the terminals 7 in position within the respective grooves 10 and in the recess 6. In accordance with a preferred feature of the invention, the recess 6 is sleeve-like or tubular, open at the bottom, so that the recess 6 forms a through-bore. The terminals 7 then can be easily welded to the leads 3 projecting from the lamp 1, since ready access is available at the junction or connecting point of the terminals 7 and lamp leads 3. Forming the recess 6 as a through-bore permits making the weld connection after complete assembly of the lamp 1 into the socket 2. This is in contrast to combinations of this type of the prior art where the terminal connection had to be made first, thus substantially complicating the assembly of the lamp-terminal connection and socket.

The upper portions of the socket terminals 7 are formed in two vertically spaced horizontal flaps which can engage over a plate-like portion P, shown only schematically in FIG. 1—when the lamp is assembled into a fixture having this plate-like portion. The plate-like portion itself may be a printed circuit board formed with suitable contact terminals at the upper side, or lower side, or both sides for engagement with the flap of the terminal elements 7. FIG. 1 illustrates the plate-like portion in exploded, unassembled position. The plate-like portion, preferably, is formed with a circular opening which has projecting rectangular cut-outs to fit the upper portions 7', of the terminal elements 7 thereover, to then, upon rotation by 90°, lock the plate in position in form of a bayonet connection. The socket 2 is additionally formed with projection lugs 12 to form a stop and insure that the lamp cannot be rotated beyond a predetermined position. The socket 2, additionally, is formed with a supporting flange 13, from which the lugs 12 extend, to form a support against the side of the plate remote from the lamp 1.

Various changes and modifications may be made, and any features described herein may be used with any of the others, within the scope of the inventive concept.

For example, and in accordance with a preferred embodiment, the outer wall 2' of the socket is axially relieved in the region of the weld connection between the terminal strip 7 and the lead 3 from the lamp to permit ready access for making the weld connection, for example by a spot weld.

We claim:

1. An integrally formed, unitary lamp socket in combination with a halogen incandescent lamp (1) wherein the halogen incandescent lamp has a base (4) formed as a glass press which includes, at least in part, a flat plate-like portion;

at least one extending projection (5) formed on, and extending transversely to the longitudinal axis (A) of, the base press (4) to define a locating, positioning and holding projection; and electrical terminal leads (3) extending from the base (4); and, wherein the socket includes an essentially cylindrical element (2) formed with a recess (6) therein shaped to receive, through an opening defining one end of said recess, the base (4) of the lamp, and the terminal leads (3) projecting therefrom;

and further comprising, a pair of oppositely positioned, resiliently deflectable separating walls (8) located in the recess (6) of the socket, defining essentially rectangular chords through said cylindrical element (2), and secured thereto, and resiliently engaging opposite flat sides of the plate-like portion of the base (4) of the lamp;

a supporting flange (13) formed with and circumferentially projecting from said cylindrical element (2) and adapted for direct mounting of said lamp-socket combination in any desired plate-like structure (P); and an engagement edge (9), formed on at least one of said separating walls (8), located and shaped with a surface extending perpendicular to the longitudinal axis (A) of said lamp press (4) for positive engagement over the holding projection (5) on the base (4) of the lamp, for positioning the lamp in the socket, holding the lamp in position, and preventing unintended axial movement of the lamp from the socket after insertion of the lamp in the socket, and for resilient snap-in of the engagement edge (9) over the holding projection (5) on the base (4) of the lamp.

2. Lamp according to claim 1, wherein the separating walls (8) are integral with the socket and comprise inwardly extending, outwardly resiliently deflectable wall portions connected at least at two of their edge portions with the socket.

3. Lamp according to claim 2, wherein the resiliently deflectable walls (8) are connected with the remainder of the socket along edges extending parallel to a longitudinal axis (A) through the lamp (1).

4. Lamp according to claim 1, werein the engagement edges (9) comprise inwardly projecting ridges extending transversely to an axis (A) passing through the lamp (1) and the socket.

5. Lamp according to claim 1, wherein the resiliently deflectable separating walls (8) are integral with the socket (2) and connected thereto at three of the edges of the separating walls (8) located remote from the opening of the recess (6);

and the engagement edges (9) comprise inwardly extending ribs located at a position close to the opening of the recess (6).

6. Lamp according to claim 1, wherein the socket and the separating wall comprise an integral plastic element.

7. Lamp according to claim 1, wherein the recess (6) is essentially cylindrical;

the separating walls extend along a chord of the recess to engage the flat, plate-like glass press (4) of the lamp;

and further including terminal strips (7) fitted into the recess (6) and positioned adjacent the lateral edge portions of the separating walls (8) and a space defined between the separating walls in which the plate-like glass press (4) can be received.

8. Lamp according to claim 7, further including inwardly extending grooves (10) formed in the socket (2) adjacent the edges of the terminal strip (7) for receiving the edge portions of the terminal strip.

9. Lamp according to claim 7, further including a radial recess formed in the socket (2) and extending in the space to receive the glass press (4) of the lamp;

and wherein the terminal strips are formed with outwardly projecting tongues (11) engaging in said radial recess.

10. Lamp according to claim 1, wherein the recess (6) within the socket (2) is a through-bore.

11. Lamp according to claim 9, wherein the recess (6) within the socket (2) is a through-bore;

and wherein the terminal strips (7) are mechanically and electrically connected to the electrical terminal leads (3) extending from the base (4) of the lamp in the region of the through-bore (6) remote from the lamp (1).

12. Lamp according to claim 11, wherein the socket (2) is formed with an outer wall (2') which is axially relieved in the region of the bonding connection between the terminal strips (7) and the electrical terminal leads (3) of the lamp.

* * * * *